US006601651B2

(12) United States Patent
Grant

(10) Patent No.: US 6,601,651 B2
(45) Date of Patent: Aug. 5, 2003

(54) DOWNHOLE GAS COMPRESSION

(75) Inventor: Angus Grant, Doune (GB)

(73) Assignee: Weir Pumps Limited (GB)

( * ) Notice: Subject to any disclaimer, the term of this patent is extended or adjusted under 35 U.S.C. 154(b) by 69 days.

(21) Appl. No.: 09/776,556

(22) Filed: Feb. 2, 2001

(65) Prior Publication Data

US 2002/0011337 A1 Jan. 31, 2002

(30) Foreign Application Priority Data

Jun. 3, 2000 (GB) ..... 0013449

(51) Int. Cl.[7] ..... E21B 43/00; E21B 4/04

(52) U.S. Cl. ..... 166/370; 166/66.4; 166/106

(58) Field of Search ..... 166/66.4, 105, 166/106, 90.1, 267, 370, 105.6; 417/366, 368

(56) References Cited

U.S. PATENT DOCUMENTS

| | | | | |
|---|---|---|---|---|
| 3,887,008 A | * | 6/1975 | Canfield | 166/267 |
| 4,969,803 A | | 11/1990 | Turanskyj | 417/247 |
| 4,969,807 A | * | 11/1990 | Kazumoto et al. | 417/417 |
| 5,044,440 A | | 9/1991 | Stinessen et al. | 166/344 |
| 5,341,058 A | | 8/1994 | Kohler et al. | 310/87 |
| 5,454,646 A | * | 10/1995 | Reisdorf | 384/901 |
| 5,456,837 A | * | 10/1995 | Peachey | 166/265 |
| 5,605,193 A | * | 2/1997 | Bearden et al. | 166/105.6 |
| 5,755,288 A | * | 5/1998 | Bearden et al. | 166/105.6 |
| 5,795,138 A | * | 8/1998 | Gozdawa | 417/243 |
| 6,015,011 A | * | 1/2000 | Hunter | 166/227 |
| 6,261,070 B1 | * | 7/2001 | Johnson | 417/366 |

FOREIGN PATENT DOCUMENTS

| | | | | |
|---|---|---|---|---|
| EP | 0297691 A1 | | 4/1989 | |
| EP | 1041243 A2 | * | 10/2000 | E21B/43/38 |
| GB | 2302892 A | | 7/1996 | |
| SU | 1374347 A1 | | 9/1986 | |
| SU | 1757028 A1 | | 2/1990 | |
| WO | WO 97/33070 | | 9/1997 | |

* cited by examiner

*Primary Examiner*—David Bagnell
*Assistant Examiner*—Brian Halford
(74) *Attorney, Agent, or Firm*—Gifford, Krass, Groh, Sprinkle, Anderson & Citkowski, P.C.

(57) ABSTRACT

A downhole gas compression system is adapted for location in a bore of a natural gas-producing well (10), the system comprising an axial flow compressor (32) and a gas-filled electric drive motor (30). The motor drives the compressor to compress the produced gas, the compressed gas being directed upwardly through production tubing (20) to surface.

47 Claims, 4 Drawing Sheets

DOWNHOLE GAS COMPRESSION

FIELD OF THE INVENTION

This invention relates to downhole gas compression, and in particular to the provision of a gas compression system suitable for use in downhole applications, and having utility in facilitating recovery of natural gas from subsurface hydrocarbon-bearing formations.

BACKGROUND OF THE INVENTION

In oil and gas production operations, a drilled bore extends from surface to intersect a hydrocarbon-bearing formation. The hydrocarbon may be in the form of a liquid or gas, or a mixture of both; for brevity, reference will be made primarily herein to production of gas. Initially, the gas, known as the produced gas, is often at sufficient pressure that it will flow from the formation, through the well bore, to surface. As the gas travels up through the bore the gas cools, and the gas velocity must be sufficient to carry the resulting condensates to surface. However, when a well has been producing gas for some time and the volume of gas remaining in the formation has decreased, often referred to as a depleting gas well, the formation pressure may fall below the wellhead manifold pressure, or the difference between the reservoir pressure and wellhead pressure may be such that a satisfactory flow rate from the well cannot be maintained; the gas must then be pumped out of the well. This is most effectively achieved by compressing the gas at a point in the well, preferably close to the production formation. However, there are many difficulties associated with compressing gas in the well, some related to the restricted space available in the well to accommodate the compressor, and also the difficulty in supplying power to the compressor.

To achieve the pressures sought in the space available, it is generally considered necessary to utilise a high speed compressor. WO 97/33070 (Shell Internationale Research Maatschappij B.V.) describes a downhole multistage rotary compressor driven by a brushless permanent magnet motor and described as being capable of operating at a speed above 5000 rpm. To reduce friction within the compressor, the compressor shaft journal bearings are gas lubricated, the gas being the produced gas which is supplied to the bearings via a small auxiliary compressor unit mounted to the main compressor. The motor and optional gearbox must however be liquid cooled and lubricated, and are therefor located in appropriate liquid-filled chambers isolated from the compressor by conventional seals.

It is among the objectives of embodiments of the present invention to provide a downhole compression system which provides an improved performance over existing proposals.

SUMMARY OF THE INVENTION

According to a first aspect of the present invention there is provided a downhole gas compression system adapted for location in a bore, the system comprising an axial flow compressor and a gas-filled electric drive motor.

The invention also relates to a method of compressing gas downhole, utilising a compressor driven by a gas-filled electric motor.

The use of a gas-filled motor avoids the friction losses associated with conventional oil-filled motors; friction losses in the rotor/stator gap and churning losses in oil-filled motors place restrictions on the speeds such motors may achieve while containing losses within tolerable levels.

The gas utilised to fill the motor may vent into the well bore, and join the produced fluid, preferably via gas valves which operate as gas seals in the opposite flow direction, preventing ingress of well fluids to the motor in the event of loss of supply gas pressure.

Conveniently, the motor and compressor are substantially axially aligned within an elongate housing, such that they may be accommodated in the confines of a well bore.

Preferably, the motor is gas lubricated, with gas being supplied to the motor bearings, which bearings are preferably hydrodynamic, but may alternatively be hydrostatic.

Preferably both the compressor and motor are liquid free, that is, the compressor set does not contain any liquids such as water, liquid hydrocarbons, liquid lubricants and the like.

Preferably, the motor is also gas cooled. In one embodiment, this allows use of produced gas to cool the motor, which gas may be directed over or around the motor as appropriate, such that the motor does not have to be contained within a finite volume of liquid, typically a lubricating oil, held in a fluid-tight housing; as described in WO 97/33070, this conventional arrangement places restrictions on the energy which may be added to the gas, as the compressed gas must be maintained at a temperature low enough to permit cooling of the oil and to avoid a phase change of the liquid motor lubricants.

Preferably, the motor drives the compressor directly, preferably on a single shaft, such that there is no requirement for a gearbox requiring liquid lubrication and cooling, and thus high speed shaft sealing arrangements.

Preferably, the motor is a brushless permanent magnet motor, and thus typically of relatively high efficiency, and most preferably of one or both of high electrical frequency and variable speed. Such a motor, if gas filled and gas lubricated, may be driven at high speeds, typically between 20,000 and 70,000 rpm; the optimum speed will depend on a number of factors, including the available bore diameter, the location of the compressor in the bore, and the properties of the produced gas. The motor may be powered by electrical supply from surface, via an inverter.

In one embodiment, a plurality of motors and compressors are provided; the compressors may be mounted in series and the motors may be connected in parallel. A motor controller and inverter may be mounted at surface, power distribution to the motors being such that the group of motors operates effectively as a single machine. Alternatively, a plurality of inverters are installed downhole, one for each motor, such that each motor can be controlled separately of the others. This arrangement provides added flexibility in operation, or redundancy, to suit changing well bore flowing conditions.

Preferably, the compressor is gas lubricated, gas being supplied to the compressor bearings, which are preferably hydrodynamic. Alternatively, the bearings may be hydrostatic, however such bearings tend to require a greater gas supply.

Preferably, gas is supplied to one or both of the motor and compressor from surface, and is preferably clean and liquid free produced gas, or other gas which is compatible with the produced gas. The gas may be compressed at surface by an auxiliary compressor. Alternatively, produced gas from the well bore may be utilised. Preferably, this gas is obtained at compressor discharge and is passed through a downhole solids and entrained liquid separator and an auxiliary compression stage before being passed to one or both of the motor and compressor.

The compressor may be single or multistage.

In some applications, where liquid slug flow may occur and which would be detrimental to compressor performance, a liquid separator may be provided before the compressor inlet. Most preferably, the separated liquid is driven, preferably by gravity, back into a section of the formation which is isolated from the production zone. Most conveniently a centrifugal separator, such as a cyclone, is utilised.

BRIEF DESCRIPTION OF THE DRAWINGS

These and other aspects of the invention will now be described, by way of example, with reference to the accompanying drawings, in which.

DETAILED DESCRIPTION OF THE DRAWINGS

Figure 1:
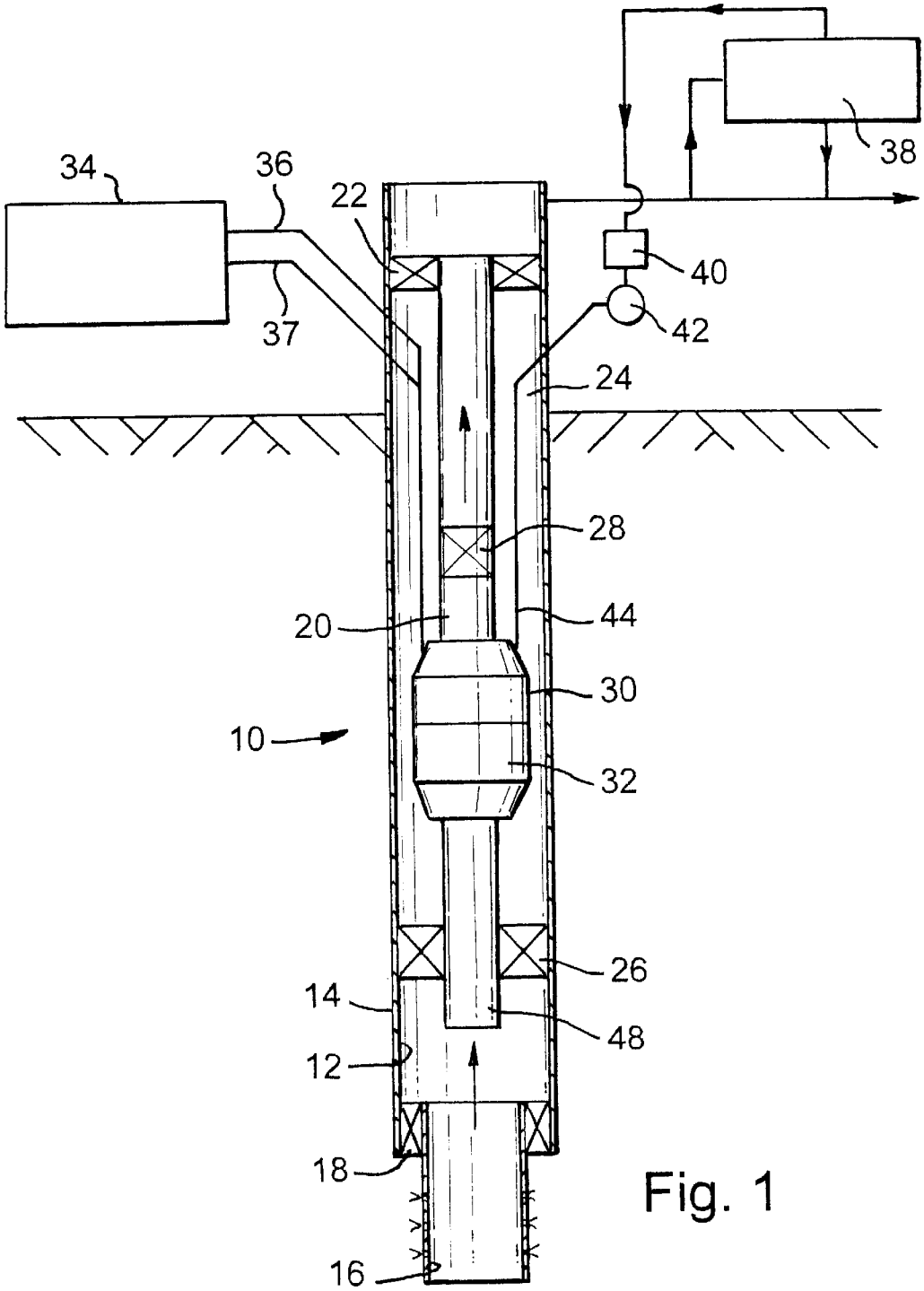
FIG. 1 is a diagrammatic illustration of a downhole gas compression system in accordance with a preferred embodiment of the present invention.

Reference is first made to FIG. 1 of the drawings, which is a diagrammatic illustration of a downhole gas compression system in accordance with a preferred embodiment of the present invention. The system is installed in a depleting gas well 10, the well comprising a bore 12 extending from the surface to a gas producing formation. Most of the length of the bore 12 is lined with metal casing 14, while the lower end of the bore 12, which intersects the gas producing formation, is lined with selectively perforated metal liner 16, the liner 16 being supported from and sealed to the casing 14 by an appropriate hanger 18. Within the casing 14, a smaller diameter string of production tubing 20 is utilised to transport the gas to surface. The upper end of the tubing 20 is secured and sealed to the casing 14 by a tubing hanger 22, and the annulus 24 between the casing 14 and the production tubing 20 is sealed by a packer 26. A safety valve 28 is provided within the production tubing 20, and mounted towards the lower end of the tubing 20 is an electric motor 30 and an axial flow compressor 32. A motor controller 34, incorporating an inverter, is provided on surface and provides power to the motor 30 via a cable 36, which passes through the annulus 24. A further cable 37 carries signals from the motor and compressor to facilitate monitoring thereof. The motor 30 drives the compressor 32 to compress produced gas, the compressed gas being directed upwardly through the production tubing 20 to surface. At surface, a proportion of the produced gas is diverted into a solid and liquid separator 38, the resulting liquid free clean gas being then passed though a filter 40 and auxiliary compressor 42 before being passed down through the annulus 24, in coiled tubing 44, to the motor 30 and compressor 32, where the gas is utilised to lubricate the motor 30 and the compressor 32, as described below.

Figure 2:
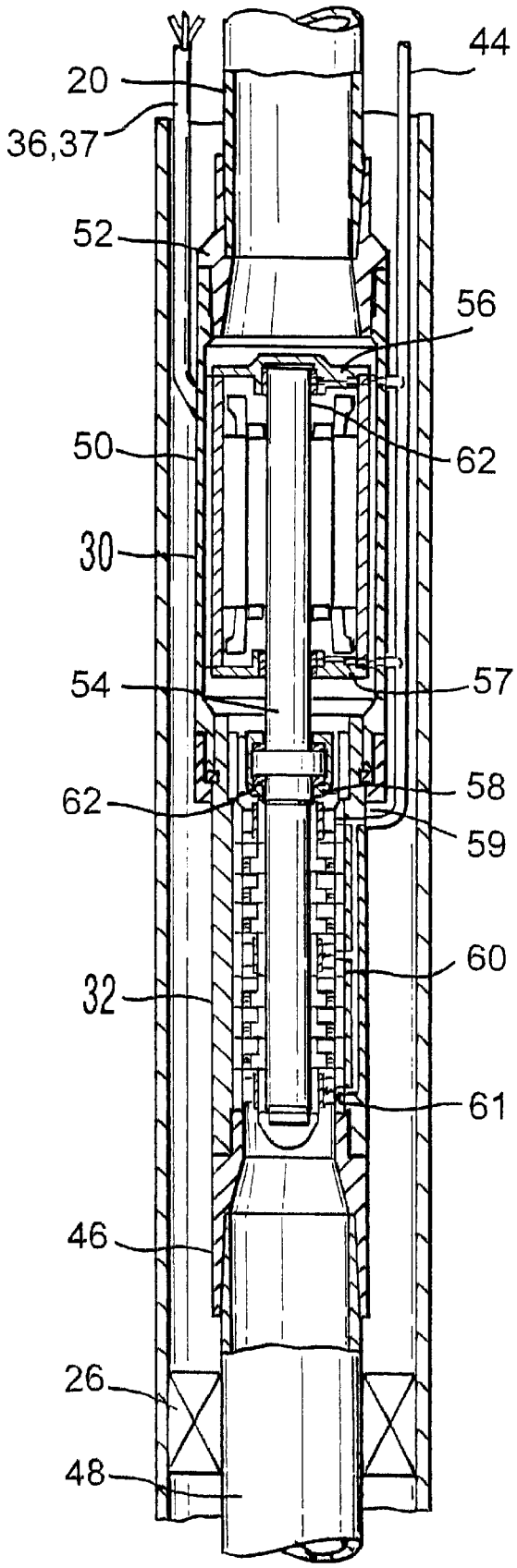
FIG. 2 is an enlarged cross-sectional view of the compressor and motor of the system of FIG. 1.

Reference is now also made to FIG. 2 of the drawings, which is an enlarged cross-sectional view of the compressor 32 and motor 30. The compressor 32 is of the multi-stage centrifugal axial flow type and is coupled, via an inlet connector 46, to tubing 48 in fluid communication with the gas producing formation, via the perforated liner 16. The gas passes up through the compressor 32 and is then directed round the motor casing 50, before passing through a discharge connector 52 and into the production tubing 20.

The motor 30 is a variable speed permanent magnet motor and drives the compressor 32 directly, via a combined motor\compressor shaft 54. The motor 30 is cooled by the flow of produced gas over the motor casing 50 and is gas filled. Further, both the motor 30 and the compressor 32 are gas lubricated, as described below.

The illustrated motor and compressor set comprises two motor journal bearings 56, 57, a double action thrust bearing 58, and three compressor journal bearings, 59, 60, 61 (in short compressor sets with few stages (one or two), the compressor stages may be overhung from the motor, this arrangement requiring no additional journal bearings in the compressor). All of the bearings 56–61 are hydrodynamic and are each supplied with filtered dry clean produced gas from surface, via the coiled tubing 44. The bearing gas lubricant, which also serves as the motor fill gas, vents into the tubing 20, and joins the produced fluid, via gas valves 62 which operate as gas seals in the opposite flow direction, thus preventing ingress of produced fluids to the bearings or motor in the event of loss of supply gas pressure.

It will be apparent to those of skill in the art that the use of a gas filled and cooled variable speed permanent magnet motor 30 as direct drive for a gas lubricated axial flow compressor 32 allow the compressor to run at very high speeds, in the region of 20,000 rpm to 70,000 rpm, allowing the produced gas to be pressurised to a level which allows efficient extraction of gas from depleted wells.

Figure 3:
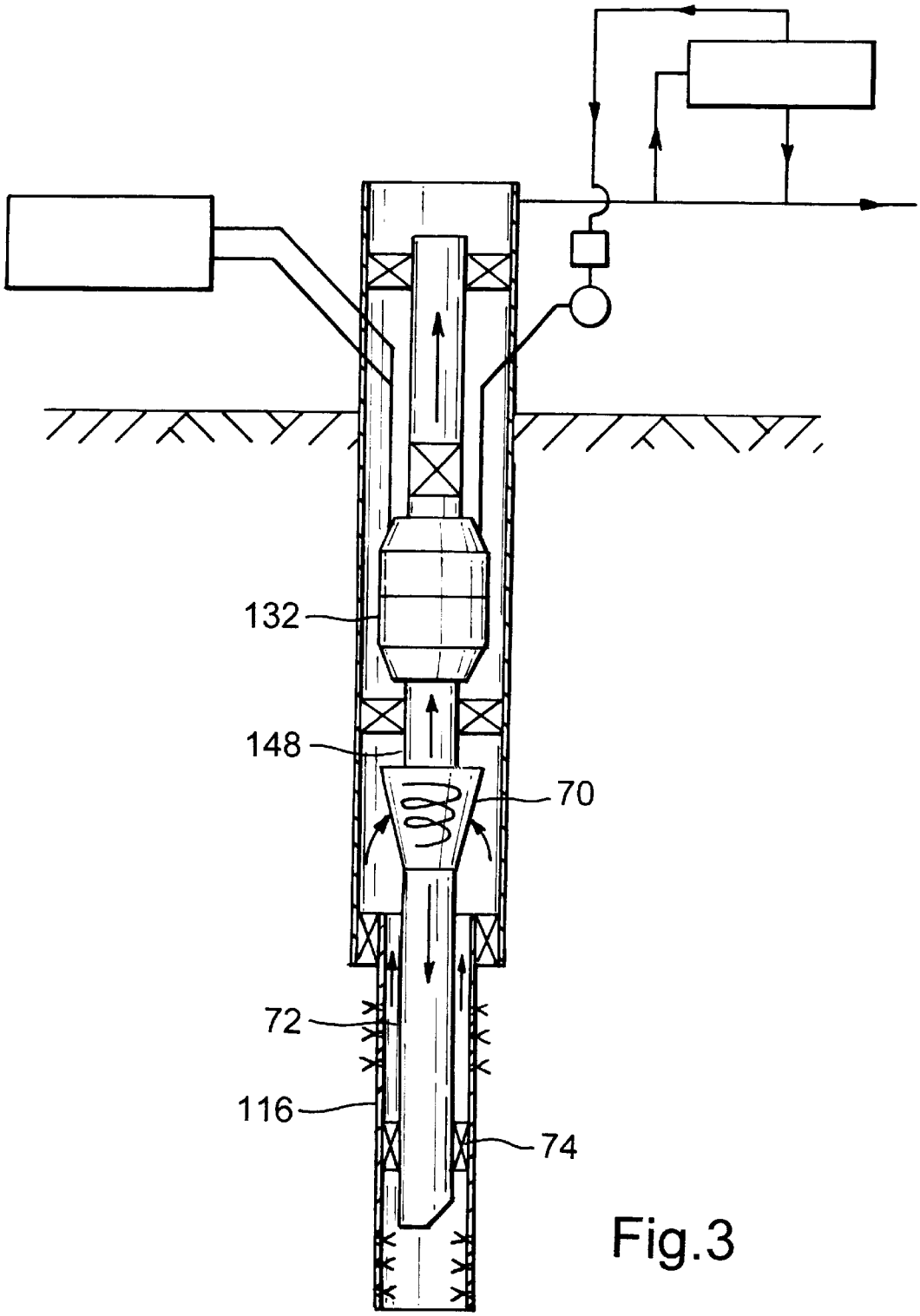
FIG. 3 is a diagrammatic illustration of a downhole gas compression system in accordance with a second embodiment of the present invention.

Reference is now made to FIG. 3 of the drawings, which illustrates a downhole gas compression system in accordance with a second embodiment of the present invention, the system being adapted for applications in which liquid slug flow may occur, and which flow conditions would be detrimental to compressor performance. The majority of the features of the system are the same as those illustrated and described with reference to FIGS. 1 and 2; these features will not be described again in any detail, and bear reference numerals corresponding to the numerals used in FIGS. 1 and 2, prefixed with a "1".

The perforated liner 116 which intersects the production formation also extends into a lower liquid re-injection zone, where the liner 116 is also perforated.

Gas and liquid pass from the production zone into the upper portion of the liner 116, and then upwardly into a gas and liquid cyclone separator 70, the produced gas passing upwardly through the compressor inlet tubing 148 to the compressor 132, while the separated produced liquid passes downwardly, relying on natural gravity, through liquid return tubing 72. The liquid return tubing 72 carries the liquid into the lower portion of the liner 116, isolated from the upper producing portion by a packer 74, where the separated liquid is re-injected into the formation. Thus, the gas reaching the compressor 132 is substantially liquid free.

Figure 4:
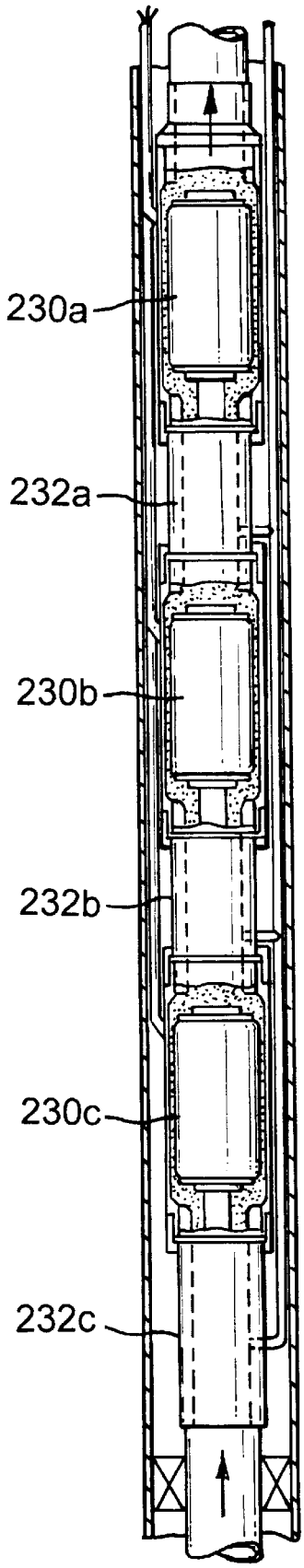
FIG. 4 is a cross-sectional view of part of a downhole gas compression system in accordance with third embodiment of the present invention.

Reference is now made to FIG. 4 of the drawings, which is a cross-sectional view of part of a downhole gas compression system in accordance with a third embodiment of the present invention. In this embodiment, multiple motors/compressor sets are provided, the compressors 232*a*, 232*b*, 232*c* being mounted in series, while the motors 230*a*, 230*b*, 230*c* are connected in parallel, that is each motor 230*a*, 230*b*, 230*c* drives a respective compressor 232*a*, 232*b*, 232*c*, independently of the other motors. As with the above-described first and second embodiments, clean gas is supplied from the surface to the motor and compressor bearings, and the motors are cooled by the flow of produced gas over the motor casings.

As with the first described embodiment, the motor controller and inverter may be provided at the surface, power distribution to the individual motors downhole being such that the multiple motors operate effectively as a single machine. Alternatively, the inverters may be installed downhole, one for each motor, such that each motor can be controlled separately of the others. This arrangement provides an added degree of flexibility in operation and\or redundancy, to suit changing well bore flowing conditions.

It will be apparent to those of skill in the art that the above-described embodiments are merely exemplary of the present invention, and that various modifications and improvements may be made thereto, without departing from the present invention. For example, rather than providing gas to lubricate the motor and compressor bearings and fill the motor from surface, the gas may be taken from the compressor discharge, solids and liquids being removed by separation downhole by cyclones or other arrangements, and after further compression in an auxiliary compressor stage the gas being fed to the bearings and motor. Further, the illustrated embodiments show the motor mounted above the compressor, however in other embodiments the compressor may be mounted above the motor, this offering the advantage that the produced gas in contact with the motor casing, and acting to cool the motor, is likely to be at a lower temperature than the compressed produced gas flowing from the compressor outlet.

I claim:

1. A downhole gas compression system adapted for location in a drilled bore extending from surface to intersect a gas-producing formation, the system comprising an axial flow compressor operatively associated with a gas-filled electric drive motor, the compressor and motor being connectable to production tubing and locatable within bore-lining casing.

2. The system of claim 1, further comprising gas valves for permitting gas utilised to fill the motor to vent from the motor and into a bore in which the motor is located.

3. The system of claim 2, wherein the gas valves are adapted to operate as gas seals an opposite flow direction a vent direction.

4. The system of claim 1, wherein the drive motor is gas lubricated.

5. The system of claim 1, wherein the motor comprises a plurality of gas lubricated bearings.

6. The system of claim 5, wherein at least some of the gas lubricated bearings are hydrodynamic.

7. The system of claim 5, wherein at least some of the gas lubricated bearings are hydrostatic.

8. The system of claim 5, wherein the motor further includes a gas supported thrust bearing.

9. The system of claim 8, wherein said gas supported thrust bearing is provided between the motor and the compressor.

10. The system of claim 1, wherein the motor is gas cooled.

11. The system of claim 10, wherein the motor is adapted to be cooled by produced gas.

12. The system of claim 1, wherein the motor is adapted to drive the compressor directly.

13. The system of claim 12, wherein the motor drives the compressor on a single shaft.

14. The system of claim 1, wherein the motor is a permanent magnet motor.

15. The system of claim 14, wherein the motor is operable at variable speed.

16. The system of claim 1, wherein the motor is adapted to be driven at speeds of between 20,000 and 70,000 rpm.

17. The system of claim 1, wherein the motor is adapted to be powered by electrical supply from surface, via an inverter.

18. The system of claim 1, further comprising a plurality of motors and a plurality of compressors.

19. The system of claim 18, wherein the compressors are mounted in series.

20. The system of claim 18, wherein the motors are connected in parallel.

21. The system of claim 18, further comprising a motor controller and an inverter adapted to be mounted at surface, power distribution to the motors such that the group of motors will operate effectively as a single machine.

22. The system of claim 18, further comprising a plurality of inverters adapted to be installed downhole, one for each of said plurality of motors, such that each motor can be controlled separately of the others.

23. The system of claim 1, wherein the compressor comprises gas lubricated bearings.

24. The system of claim 23, wherein the compressor bearings are hydrodynamic.

25. The system of claim 23, wherein the compressor bearings are hydrostatic.

26. The system of claim 23, further comprising means for supplying lubricating gas to at least one of the motor and compressor.

27. The system of claim 26, wherein said means is adapted to provide clean and liquid free produced gas.

28. The system of claim 27, wherein said means includes means for removing at least one of solids and liquids from the gas.

29. The system of claim 26, further comprising an auxiliary compressor to compress the gas.

30. The system of claim 26, wherein said means is adapted to supply gas from surface.

31. The system of claim 26, further comprising means for supplying lubricating produced gas directly from a bore in which the motor and compressor are located to at least one of the motor and compressor.

32. The system of claim 31, further comprising a downhole solids and entrained liquid separator and an auxiliary compression stage whereby, in use, gas obtained at compressor discharge is passed therethrough before being passed to at least one of the motor and compressor.

33. The system of claim 1, wherein the compressor has a single stage.

34. The system of claim 1, wherein the compressor is multistage.

35. The system of claim 1, wherein the compressor further comprises an inlet and a liquid separator disposed before the compressor inlet.

36. The system of claim 35, wherein, in use, separated liquid is driven back into a section of formation isolated from the production zone.

37. The system of claim 35, wherein said separator is a centrifugal separator.

38. The system of claim 1 wherein the compressor is liquid free.

39. The system of claim 1 wherein the motor is liquid free.

40. The system of claim 1 wherein the compressor and motor are axially aligned and are accommodated in an elongate housing.

41. A downhole gas compression system for location in a bore, the system comprising an axial flow compressor and a gas-filled permanent magnet electric drive motor.

42. A method of compressing produced gas in a drilled bore extending from surface to intersect a gas-producing formation, utilizing a compressor driven by a gas-filled electric motor, the compressor and motor being connected to production tubing and located within bore-lining casing.

43. A downhole gas compression system comprising an axial flow, gas lubricated, liquid free compressor directly driven by a gas filled, gas cooled, gas lubricated, liquid free, variable speed, permanent magnet electric drive motor.

44. The system of claim 43 wherein the compressor and motor are axially aligned and are accommodated in an elongate housing.

45. A method of compressing gas in a bore for transporting the gas to surface, the method comprising: passing produced gas through a downhole, axial flow, gas lubricated, liquid free compressor; and directly driving the compressor with a downhole, gas filled, gas cooled, gas lubricated, liquid free, variable speed, permanent magnet electric drive motor.

46. The method of claim 45, further comprising the step of supplying filtered dry lubricating gas to lubricate the compressor and motor.

47. The method of claim 45, further comprising the step of supplying the lubricating gas from surface.

* * * * *